US006647694B2

(12) United States Patent
Katsura

(10) Patent No.: US 6,647,694 B2
(45) Date of Patent: Nov. 18, 2003

(54) PANEL BODY USING HELICAL WIRE MEMBERS

(75) Inventor: Nobuhiko Katsura, 339-5, Kubara 1-chome, Omura-shi, Nagasaki 856-0835 (JP)

(73) Assignees: Nippon Steel Corporation, Tokyo (JP); Nobuhiko Katsura, Nagasaki (JP); Taihei Manufacturing Co., Ltd., Osaka (JP)

( * ) Notice: Subject to any disclaimer, the term of this patent is extended or adjusted under 35 U.S.C. 154(b) by 84 days.

(21) Appl. No.: 10/048,365

(22) PCT Filed: May 21, 2001

(86) PCT No.: PCT/JP01/04229

§ 371 (c)(1),
(2), (4) Date: Jan. 24, 2002

(87) PCT Pub. No.: WO01/90503

PCT Pub. Date: Nov. 29, 2001

(65) Prior Publication Data

US 2002/0104284 A1 Aug. 8, 2002

(30) Foreign Application Priority Data

May 25, 2000 (JP) ..... 2000-153989

(51) Int. Cl.[7] ..... E04C 2/30; E04C 2/38
(52) U.S. Cl. ..... 52/782.1; 428/222
(58) Field of Search ..... 52/782.1, 343, 52/750; 428/222; 245/1, 11

(56) References Cited

U.S. PATENT DOCUMENTS 5,419,949 A * 5/1995 Marx et al. ..... 428/222
5,753,355 A * 5/1998 Katsura ..... 428/222

FOREIGN PATENT DOCUMENTS

| | | | |
|---|---|---|---|
| JP | 8-290501 | 11/1996 | |
| JP | 8-291587 | 11/1996 | |
| JP | 9-314709 | 12/1997 | |
| JP | 2001-329652 | * 11/2001 | ..... E04C/2/42 |

* cited by examiner

*Primary Examiner*—Robert Canfield
(74) *Attorney, Agent, or Firm*—Kenyon & Kenyon

(57) ABSTRACT

This invention provides a panel body that can be easily assembled by using helical wire members having an excellent working factor. The invention provides also a panel body using helical wire members having excellent impact resistance. Wire members having a predetermined outer diameter are wound in a predetermined lead and pitch to provide a large number of helical wire members in such a fashion that a diameter of a helix is about twice the outer diameter of the wire members, crests and troughs have substantially a similar shape, and each trough is positioned outside the center of helix. A first fixing frame has first fixing bars fitted thereto, which first fixing bars are fitted with predetermined gaps to frame members opposing each other with a predetermined gap between them, and engage with the troughs positioned on the side of one of the surfaces of the helical wire members. Second fixing bars are fitted with predetermined gaps between the frame members of a second fixing frame. When the first and second fixing frames are fixed, the second fixing bars are engaged with the troughs positioned on the other side surface side of the helical wire members, and are clamped and fixed in cooperation with the first fixing bars.

2 Claims, 7 Drawing Sheets

PANEL BODY USING HELICAL WIRE MEMBERS

TECHNICAL FIELD

This invention relates to a panel body using helical wire members having high toughness and being excellent in impact resistance.

BACKGROUND ART

In biological tissues of living bodies such as bone, tendon and blood vessel, collagen filaments having a helical structure with flexibility constitute fibers for crests and troughs are united side by side. The biological tissue dispersedly supports an external force applied thereto on the helical slope of the collagen filaments united side by side, and exhibits high toughness. When some of the collagen filaments are damaged, the biological tissue exchanges the damaged collagen filaments with new ones, according to the metabolism, so as to maintain the tissue.

The inventor of this invention filed Japanese Unexamined Patent Publication (Kokai) Nos. 8-290501, 8-291587 and 9-314709 on the basis of the helical structure of the collagen filaments, in particular. The technologies described in these Laid-Open Patent Publications propose building structures such as a post member, a wall member and a sheet member all of which combine helical wire members, can provide high toughness and can easily be repaired when a part of the structure is damaged. Japanese Unexamined Patent Publication (Kokai) Nos. 8-290501 and 8-291587 describe a helical structure obtained by uniting helical bodies, with their crests and troughs side by side, wherein each helical body is formed by winding in predetermined lead and predetermined pitch, wire members having a predetermined diameter into a shape such that a diameter of a helix is about twice the wire diameter, the crests and the troughs oppose one another or have substantially a similar shape, and the troughs are positioned outside from the center of the helix, or a helical structure wherein the helical bodies are wound in the same winding direction or are wound alternately. In the helical structure described above, Japanese unexamined Patent Publication (Kokai) No. 9-314709 proposes a helical structure by combining, vertically and transversely, helical wire members for a helical structure and forming a planar mesh, wherein the helical wire members can strongly fix or release the uniting state of the helical bodies, can exhibit a predetermined motion in accordance with an environmental change and can keep the size of the mesh constant.

DISCLOSURE OF THE INVENTION

It is an object of the present invention to provide a panel body that can be easily assembled by using the helical wire members described above and has an excellent working factor. It is another object of the present invention to provide a panel body by using helical wire members having high toughness and excellent impact resistance.

The first invention of the present invention provides a panel body using helical wire members, comprising a large number of helical wire members each obtained by helically winding, in a predetermined lead and pitch, a wire material having a predetermined outer diameter in such a fashion that a diameter of a helix is about twice the outer diameter of the wire material, crests and troughs of the wire material have substantially a similar shape and each of the troughs is positioned outside the center of the helix; a first fixing frame having first fixing bars fitted thereto, the first fixing bars being fitted with predetermined gaps to frame members opposing each other with a predetermined gap between them, and engaging with the troughs positioned on the side of one of the surfaces of the helical wire members; and a second fixing frame having second fixing bars fitted thereto, the second fixing bars being fitted with predetermined gaps to frame members fixed to the frame members of said first frame, engaging with the troughs on the other side surface side and fixing a large number of helical wire members.

BEST MODE FOR CARRYING OUT THE INVENTION

Hereinafter, embodiments of the present invention will be explained with reference to the drawings.

Embodiment 1

Referring to FIGS. 1 to 6, a helical wire member 1 is made of various wire materials such as metal, plastic, ceramic (inclusive of glass), concrete, carbon fiber, and wood. The diameter of a helix is about twice the diameter of the wire member. The wire material 1 is wound in predetermined lead and pitch in such a fashion that crests 1*a* of the helical wire member 1 and its troughs 1*b* have substantially a similar shape, or the troughs are positioned are in conformity with, or are outside from, the center of the helix. Owing to this winding structure, the helical wire members 1 are wound so that a space at the helical center does not exist when viewed from the axial direction.

Figure 2:
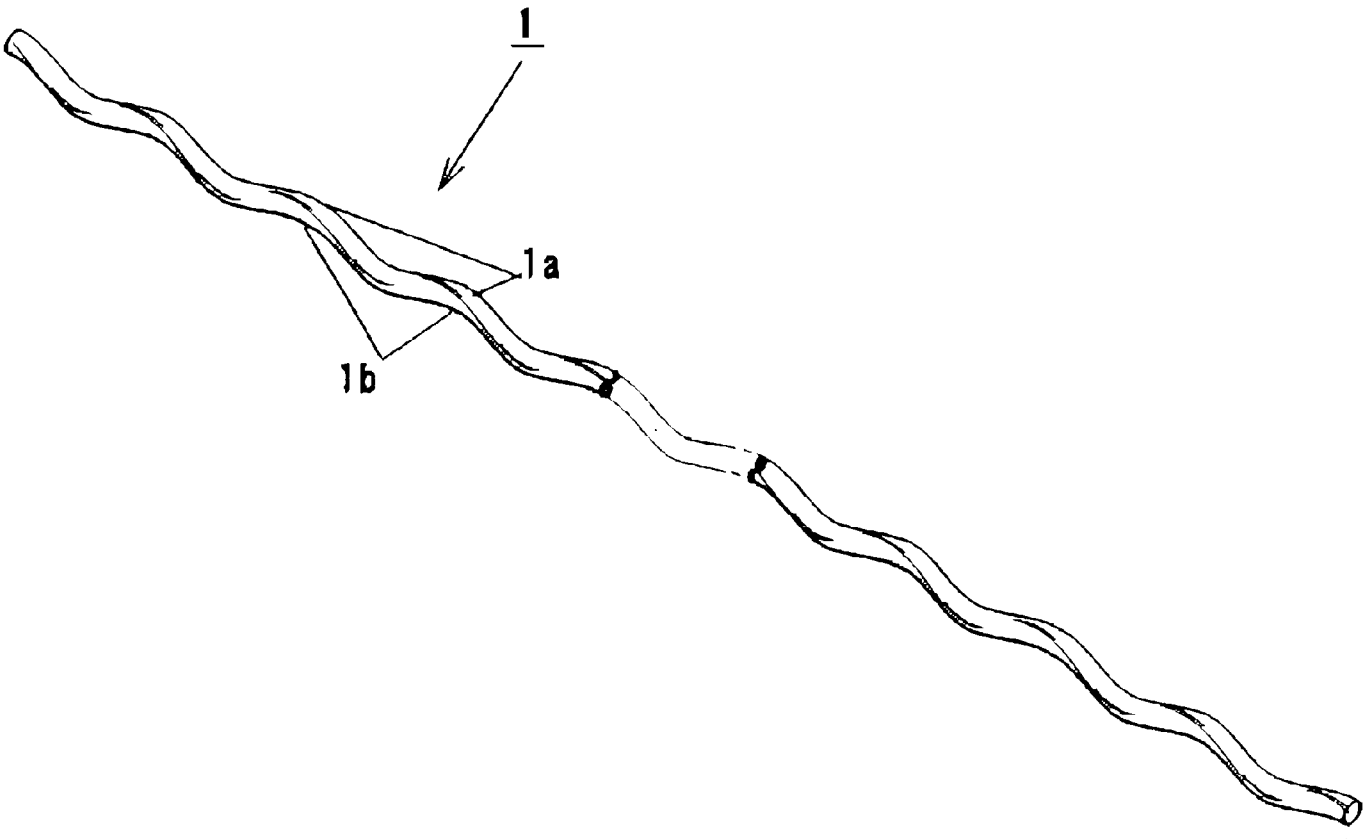
FIG. 2 is a perspective view of a helical wire member according to the present invention.
Figure 3:
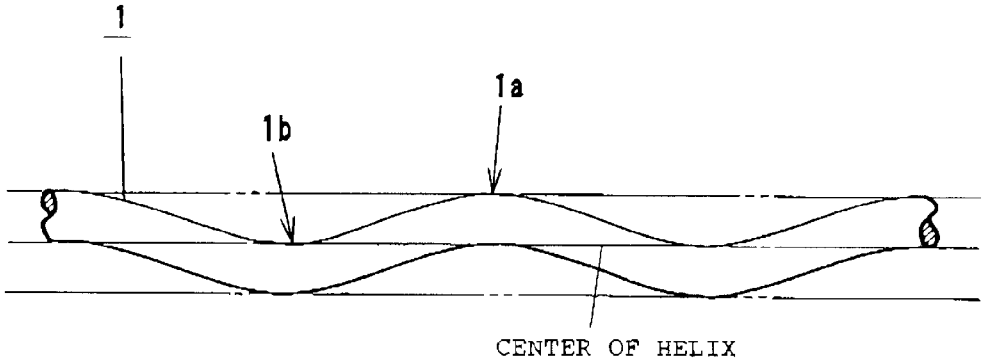
FIG. 3 is a front view showing a winding state of the helical wire member according to the present invention.

Incidentally, the helical wire member 1 shown in FIGS. 2 and 3 has a right-turn helical structure. However, the winding structure of the helix is not limited, and a left-turn helical structure may be used, as well.

A panel body 3 using the helical wire members 1 is constituted in the following way.

Figure 1:
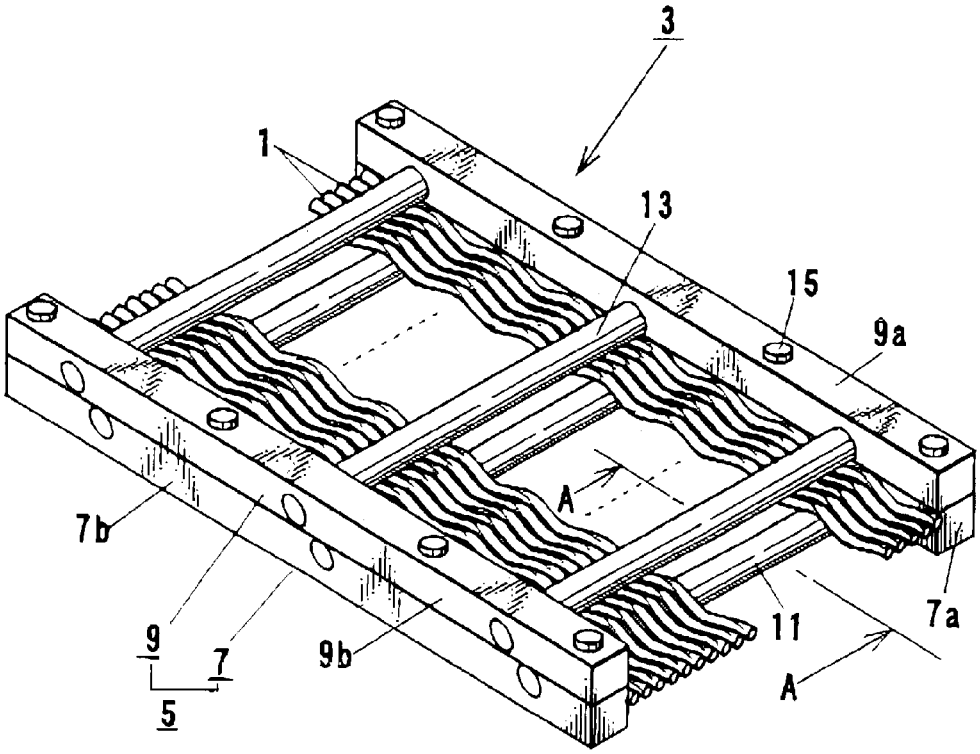
FIG. 1 is a perspective view of a panel body according to the present invention.

A frame 5 of the panel body 3 shown in FIG. 1 includes a pair of right and left fixing frames 7 and 9. Each fixing frame 7, 9 includes an upper frame 7*a*, 9*a* and a lower frame 7*b*, 9*b* that have the same width as a desired with of the panel body 3 and oppose each other. A plurality of fixing bars 11 having an axis thereof extending in a direction crossing the longitudinal direction of the upper and lower frames 7*a* and 7*b* are fitted to these upper and lower frames 7*a* and 7*b* of one of the fixing frames 7 with gaps between them such that they can engage with the troughs 1*b* of the helical wire members 1 in the longitudinal direction.

Figure 4:
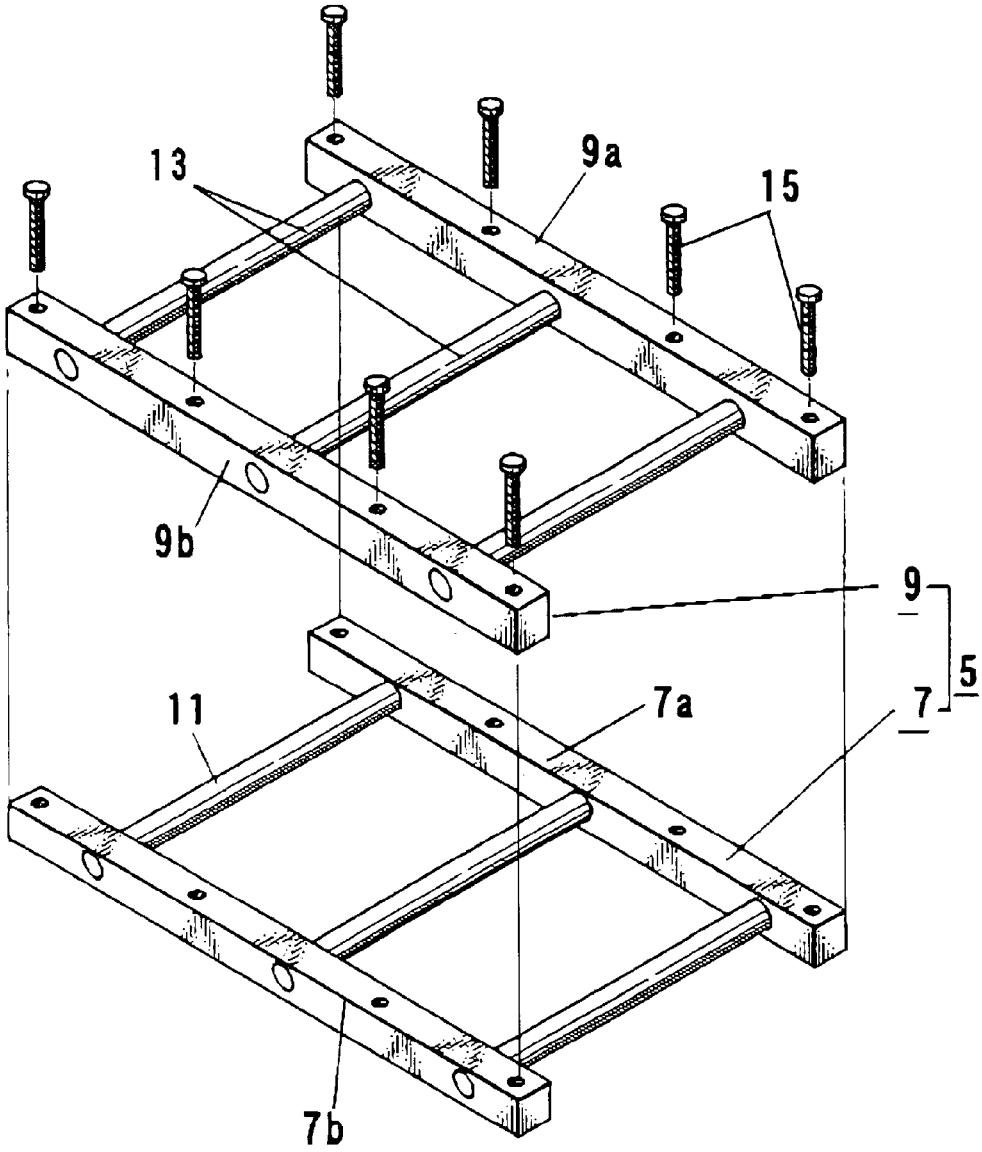
FIG. 4 is a perspective view of a frame of the panel body according to the present invention.

As shown in FIG. 4, a plurality of fixing bars 13 having an axis thereof extending in the direction crossing the longitudinal direction of the upper and lower frames 9*a* and 9*b* are fitted to these upper and lower frames 9*a* and 9*b* of the other fixing frames 9 at the positions deviated by one trough 10 relative to the fixing bars 11 of the fixing frame 7, respectively. Incidentally, the deviation width between the fixing bar 11 and the fixing bar 13 is not particularly limited to the width of one trough 10 as described above, but may be set to a width corresponding to an arbitrary number of troughs. In a preferred embodiment, however, fixing bars 11 and 13 preferably clamp the helical wire member 1 with the deviation width of one trough.

Figure 5:
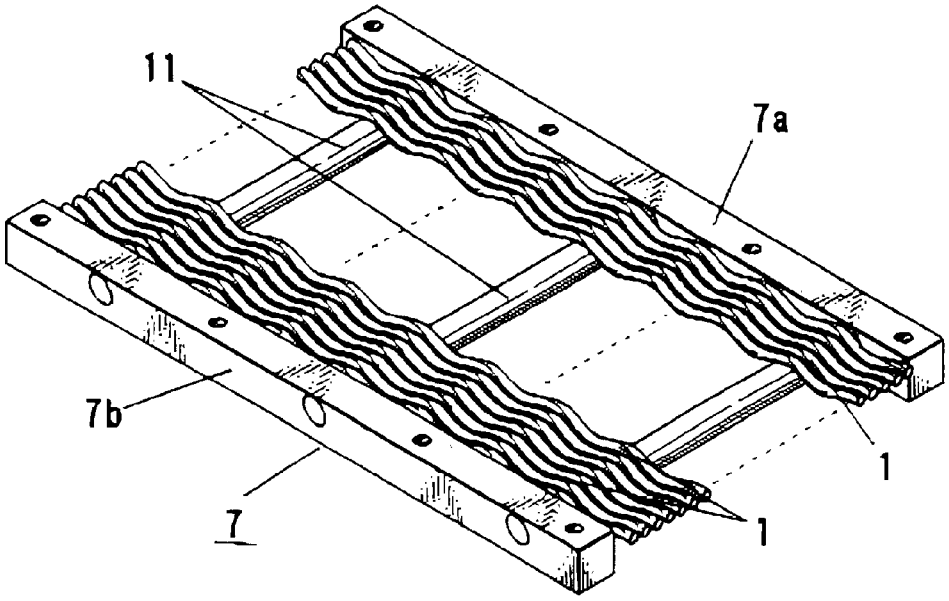
FIG. 5 is a perspective view showing an arrangement state of the helical wire members to one of fixing frames in the panel body according to the present invention.

As shown in FIG. 5, a large number of helical wire members 1 having the axis thereof extending in the direction crossing the axis of the fixing bars 11 are arranged in close contact with one another on the fixing bars 11 of one of the fixing frames 7 in such a fashion that their crests 1*a* and their troughs 1*b* mutually unite side by side. At this time, each fixing bar 11 of the fixing frame 7 engages with the trough 1*b* of each helical wire member 1 so arranged.

Figure 6:
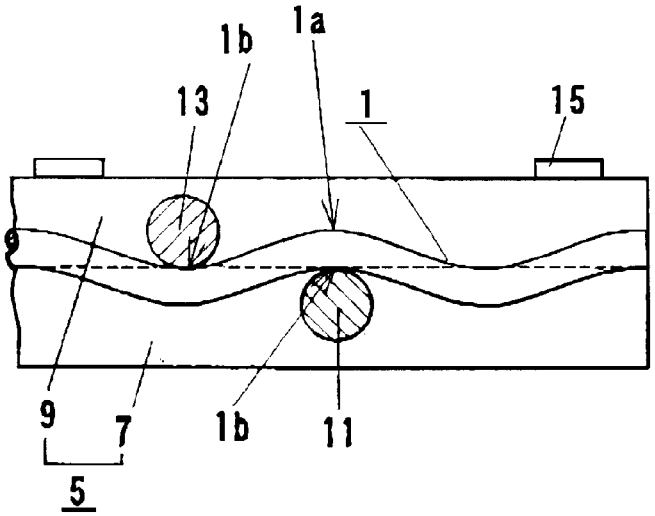
FIG. 6 is a sectional view of the panel body taken along a line A—A in FIG. 1.

In the present invention, the panel body 3 is assembled as the other fixing frame 9 is put on, and fixed to, one of the fixing frame 7 having a large number of helical wire members 1 arranged thereon as shown in FIGS. 1 and 6. To fix the fixing frames 7 and 9 put one upon another, the upper frames 7*a* and 9*a* and the lower frames 7*b* and 9*b* may be fastened by using screws 15, or may be bonded to one another.

The panel body 3 so constituted is interconnected with one another in the following way and is used. Channel members having a connection recess formed on each side are used, and the end portion of an adjacent panel body 3 is fitted into the interconnection recess of the channel member, and is fastened by using a screw, whenever necessary.

Another interconnecting method is as follows. Every other wire member of a large number of helical wire members 1 arranged on the panel body 3, for example, are rotated so that the end portion of the helical wire member 1 protrudes from one of the end portions of the panel body 3 in a predetermined width. Accordingly, recesses corresponding to the protruding width are formed at the other end in every other of the helical wire members 1.

The end portion of the protruding helical wire member 1 is fitted into the recess at the other end of the adjacent panel body 3, and the crest 1*a* and trough 1*b* are united respectively with the crest 1*a* and trough 1*b* of the adjacent helical wire member 1 to thereby interconnect the panel bodies 3 with one another.

In this interconnecting method, one of the ends of a part of the helical wire members 1 may be so arranged as to protrude by a predetermined width to the other helical wire members 1 to constitute the panel body 3.

In the panel body 3 according to this embodiment, the helical wire member 1 itself has a diameter of the helix that is about twice the diameter of the helical wire member 1. Therefore, in comparison with one sheet-like panel body, the panel can be constituted by about ½ of the materials, and the weight can be reduced. At a working site, the panel body 3 can be assembled by arranging a large number of helical wire members 1 on one of the fixing frames 7 and then putting and fixing the other fixing frame 9. Therefore, transportation efficiency can be improved.

Although the panel 3 can be constituted by ½ of the materials, the force acting on the panel body 3 can be borne and dispersed by the helical slope of the crests 1*a* of each helical wire member 1 and its troughs 1*b* that unite with one another side by side. Therefore, the panel 3 has high strength.

When a part of the helical wire members 1 in the panel body 3 is damaged, the damaged helical wire member 1 is rotated and pulled out. Then, a new helical wire member 1 is inserted among the helical wire members 1 and is rotated so that the crest 1*a* and the trough 1*b* can be united with the crest 1*a* and the trough 1*b* of the adjacent wire member 1 side by side. In this way, repair can be done.

In the explanation given above, the panel body 3 is constituted by arranging a large number of helical wire members 1 having the same winding direction (e.g. right-turn), and clamping and fixing them by the fixing bars 11 and 13 engaging with the troughs 1*b* on both surface sides. It is also possible to constitute a panel body 3 by arranging the left-turn helical wire members 1 in the same way as described above. To interconnect a plurality of panel bodies, the right-turn helical panel bodies and the left-turn helical panel bodies may be alternately arranged and interconnected. In this case, the resulting product more strongly resists deformation in the diagonal direction and can restrict this deformation better than when the helical panel bodies having the same helical direction are used. A similar effect can also be obtained, for example, when the left-turn helical wire members are arranged in superposition on the right-turn helical wire members and clamping them by the fixing bars to constitute a multi-layered panel body.

Embodiment 2

Figure 7:
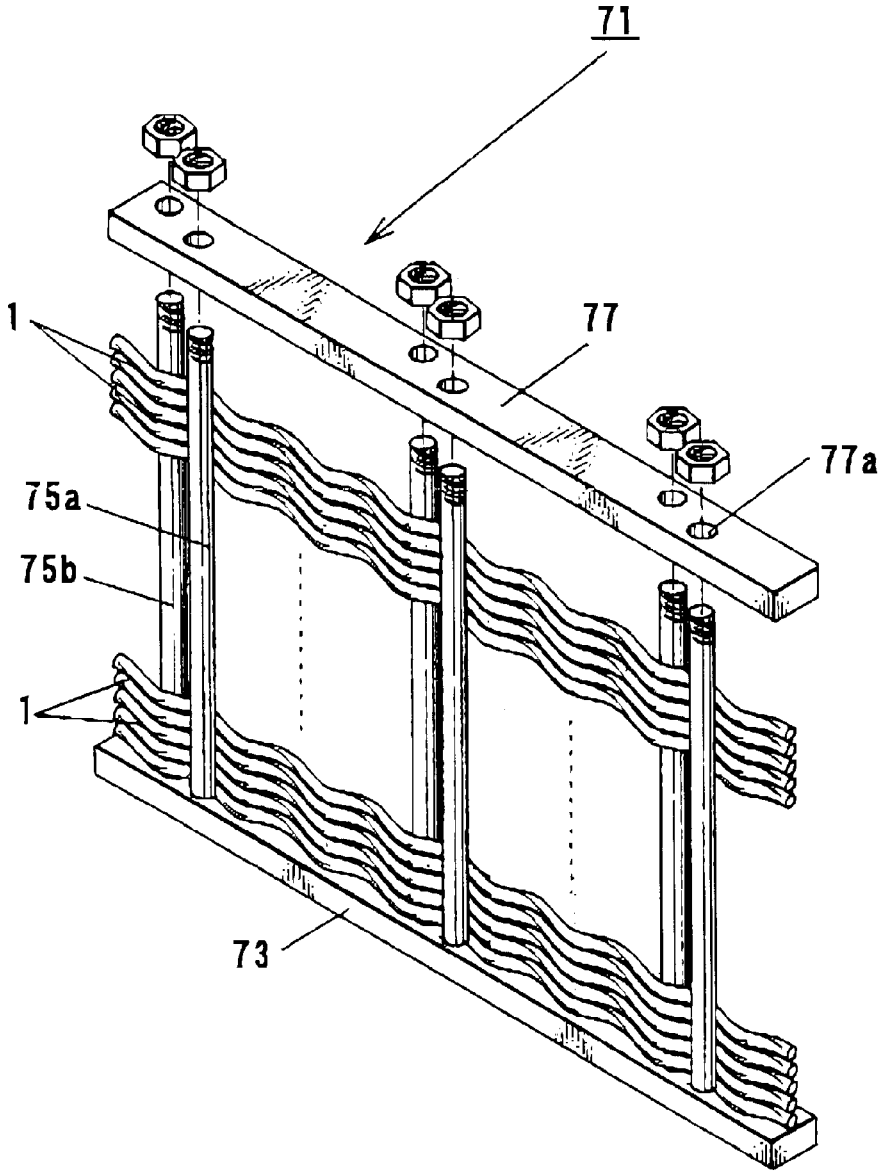
FIG. 7 is an exploded perspective view showing a panel body according to Embodiment 2 of the present invention.

Pairs of fixing bars 75*a* and 75*b* spaced apart from each other by a gap corresponding to one crest 1*a* or one trough 1*b* of the helical wire member are implanted to a frame 73 of a panel body 71 with a suitable gap in the longitudinal direction as shown in FIG. 7. A large number of helical wire members 1 are arranged between each pair of fixing bars 75*a* and 75*b* in such a fashion that the fixing bar 75*a* engages with the troughs 1*b* on the front side and the fixing bar 75*b* engages with the troughs 1*b* on the back side.

Figure 8:
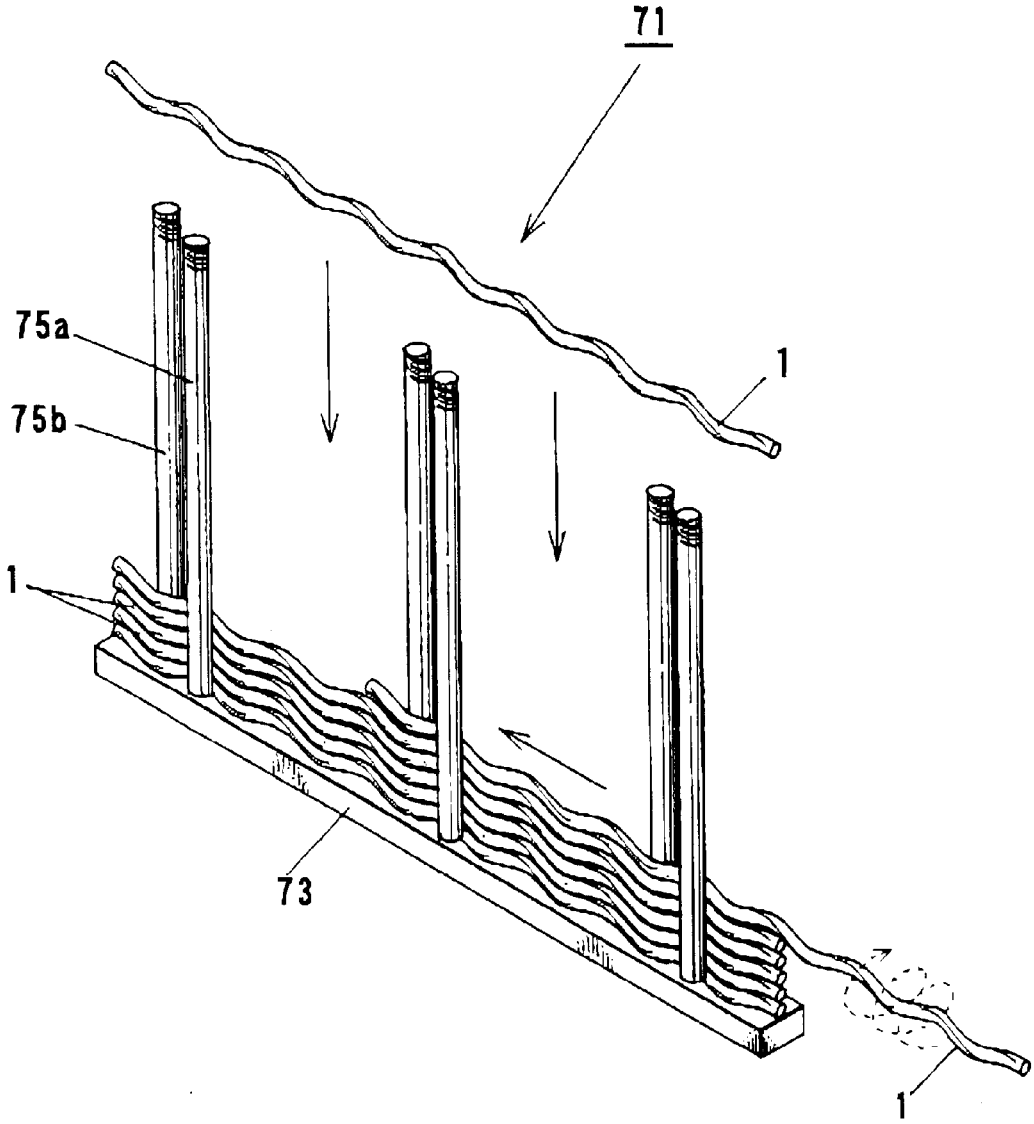
FIG. 8 is an explanatory view showing an arranging method of the helical wire members according to the present invention.

The arranging method of each helical wire member 1 to the frame 73 may be either the method that pushes each helical wire member 1 from above the frame 73 between each pair of fixing bars 75*a* and 75*b* as shown in FIG. 8, or the method that rotates the helical wire member 1 while the distal end portion is inserted from the side of the frame 73 between the fixing bars 7*a* and 75*b* as indicated by broken arrow in FIG. 8, and moves the helical wire member 1 so that the fixing bars 75*a* and 75*b* engage with the troughs 1*b*.

While a predetermined number of helical wire members 1 are arranged between each pair of fixing bars 75*a* and 75*b*, the fixing frame 77 is fixed to the upper end portions of the fixing bars 75*a* and 75*b* to assemble the panel body 71. Through-holes 77*a* are bored in the fixing frame 77 at positions corresponding to the fixing bars 75*a* and 75*b*, and screws are threaded at the upper end of the fixing bars 75*a* and 75*b*. After a necessary number of helical wire members 1 are arranged between the fixing bars 75*a* and 75*b*, the fixing frame 77 is fitted to the upper part of the fixing bars 75 and 75*b* and is fastened by screw engagement to form the panel body 71.

This embodiment 2 is different from the embodiment 1 in only the assembling method, and its function and effect is the same as that of the embodiment 1. The resulting panel body has high tenacity, high impact resistance and good assembly factor.

Incidentally, this embodiment can form the panel body comprising a curve surface by fixing a large number of helical wire members 1 arranged by using the fixing bars curved into a predetermined shape.

INDUSTRIAL APPLICABILITY

The panel body using the helical wire members according to the present invention has excellent one-site assembly factor. It has high toughness and high impact resistance.

What is claimed is:

1. A panel body, using helical wire members, comprising:

a large number of helical wire members obtained by helically winding, at a predetermined lead and pitch, wire materials having a predetermined outer diameter in such a fashion that a diameter of a helix is about twice the outer diameter of said wire materials, crests and troughs of said wire materials have substantially a similar shape and each of said troughs is positioned outside the center of the helix;

a first fixing frame having first fixing bars fitted thereto, said first fixing bars being fitted with predetermined gaps to frame members opposing each other with a predetermined gap between them, and engaging with said troughs positioned on the side of one of the surfaces of said helical wire members; and a second fixing frame having second fixing bars fitted thereto, said second fixing bars being fitted with predetermined gaps to frame members fixed to said frame members of said first frame, engaging with said troughs on the other side surface side and fixing said large number of helical wire members.

2. A panel body, using helical wire members, comprising:

a large number of helical wire members obtained by helically winding, in a predetermined lead and pitch, wire materials having a predetermined outer diameter in such a fashion that a diameter of a helix is about twice the outer diameter of said wire materials, crests and troughs of said wire materials have substantially a similar shape and each of said troughs is positioned outside the center of the helix;

support frames provided with a plurality of pairs of fixing bars with predetermined gaps in a longitudinal direction thereof, each pair of said fixing bars being fixed by support frame members on both sides of the axis of said helical wire members, and engaging with said troughs of said helical wire members arranged between said pair of fixing bars on the front side and the back side; and fixing members fixed to distal end portions of said fixing bars through which said helical wire members are arranged while said fixing bars engage with said troughs, and fastening each of said helical wire members.

* * * * *